US008196327B2

(12) United States Patent
Rich

(10) Patent No.: US 8,196,327 B2
(45) Date of Patent: Jun. 12, 2012

(54) MODULAR MAGAZINE ASSEMBLY

(76) Inventor: Kevin Wayne Rich, Middleton, ID (US)

( * ) Notice: Subject to any disclaimer, the term of this patent is extended or adjusted under 35 U.S.C. 154(b) by 172 days.

(21) Appl. No.: 12/575,406

(22) Filed: Oct. 7, 2009

(65) Prior Publication Data

US 2011/0078937 A1 Apr. 7, 2011

(51) Int. Cl.
*F41A 9/61* (2006.01)

(52) U.S. Cl. ..... 42/49.01; 89/33.17

(58) Field of Classification Search ..... 42/6, 7, 42/49.01, 49.02; 89/33.1, 33.16, 33.17, 33.02
See application file for complete search history.

(56) References Cited

U.S. PATENT DOCUMENTS 1,407,633 A * 2/1922 Burton ..... 42/50
2,338,984 A * 1/1944 Van Horn et al. ..... 42/50
D256,489 S 8/1980 Stokes
D268,511 S 4/1983 Gwinn, Jr.
4,413,546 A * 11/1983 Taylor, Jr. ..... 89/33.02
D274,170 S 6/1984 Retzlaff et al.
H164 H * 11/1986 Savioli ..... 89/33.02
4,658,700 A 4/1987 Sullivan
4,689,907 A * 9/1987 Gwinn, Jr. ..... 42/50
4,745,842 A * 5/1988 Shou-Fu ..... 89/33.02
D297,661 S 9/1988 Gwinn, Jr.
4,926,742 A 5/1990 Ma et al.

* cited by examiner

*Primary Examiner* — Gabriel Klein
(74) *Attorney, Agent, or Firm* — Parsons Behle & Latimer

(57) ABSTRACT

A modular magazine for a firearm is disclosed. The magazine has a tower and a magazine body. The tower and magazine body are modular and can be disconnected from each other. When disconnected, the tower can be paired with other magazine bodies. Also, the magazine body may be connected to other suitable towers. Different towers may allow a magazine to connect with a plurality of styles of firearm. Also, a plurality of styles of magazine may be used with a single firearm when connected to a suitable modular tower.

20 Claims, 10 Drawing Sheets

MODULAR MAGAZINE ASSEMBLY

BACKGROUND

The present disclosure relates generally to firearms. More specifically, the present disclosure relates to a firearm magazine that can be used with more one style of firearm.

A magazine is used to hold and supply ammunition to a firearm. Some firearms have built in magazines that are not removable, but many firearms have a removable magazine that can be replaced by another magazine of the same style. Generally, magazines are not interchangeable between different designs, though some firearms are designed such that they may accept more than one magazine type.

Often, magazines hold too little ammunition for a users needs. This is especially true for firearms that are designed to accommodate rapid sustained discharge. To address this issue, high capacity magazines have been designed and manufactured. Some of these high capacity magazines, such as a high capacity box magazine, are simply extensions of a smaller magazine. By contrast, some high capacity magazines use more complex mechanisms such as those with gear and belt systems, rotary mechanisms, drum mechanisms, and other suitable mechanisms. Typically, high capacity magazines are designed to be used with one specific style of firearm.

There are generally two types of common cartridges that are used in small firearms, center fire and rim fire. The two types of cartridges differ in their physical dimensions. Center fire cartridges are generally cylindrical with a circular indentation around the base of the metallic case. By contrast, rim fire cartridges have a circular protrusion (rim) around the base. While center fire cartridges can be easily stacked in parallel within a magazine, rim fire cartridges cannot be stacked or piled upon each other in a magazine without some mechanism to compensate for the difference in diameter between the front and the back of the cartridge.

The present disclosure is directed toward overcoming, or at least reducing the effects of one or more of the issues set forth above.

SUMMARY

An embodiment of a modular magazine assembly is disclosed, which may comprise a tower which may be adapted to be connected to a magazine port of a firearm and which may be configured to feed cartridges to the firearm. The assembly may further comprise and a magazine body which may be connected to the tower and configured to convey cartridges to the tower. The tower may be configured to connect to a plurality of styles of magazine bodies. The magazine body may be configured to connect to a plurality of styles of towers. The magazine body may be of a drum magazine style, stick magazine style, box magazine style, tubular magazine style, rotary magazine style, pan magazine style, or helical magazine style. The firearm may be a RUGER 10/22 .22 caliber rifle or an AR-15 rifle. The magazine body and tower may be configured to accommodate rim fire style ammunition. The tower may further comprise an ammunition feed path and the ammunition feed path may be curved at an arc. The curved arc may have a radius of about 6.25 inches.

Another embodiment of a modular magazine assembly may comprise a modular magazine body which may be configured to be loaded with cartridges of ammunition, and a modular tower which may be connected to the modular magazine at a first end of the tower by a connecting mechanism. The modular tower may have an ammunition feed path extending from the first end of the tower to a second end of the tower. The second end of the tower may have a cartridge seat that constricts the feed path. The tower may be configured to connect to a single configuration of magazine port. The modular magazine body may be configured to provide cartridges of ammunition to the modular tower. The modular magazine body may further comprise a cartridge gear. The modular magazine assembly may further comprise a follower connected to the cartridge gear. The modular magazine assembly may further comprise a dummy round stack connected to the cartridge gear.

An embodiment of a tower may comprise a first end which may have a first interface that is configured to be accepted by a magazine port of a firearm. The first end may include a cartridge seat. The tower may further comprise a second end which may have a second interface configured to connect to a magazine body. An ammunition feed path may extend from the first end to the second end, may be constricted by the cartridge seat, and may be configured to convey cartridges between the second end and the first end. The tower may further comprise a ramp tab connected to the second end of the tower. The second end may comprise one or more flanges. The tower may be configured to feed rim fire style cartridges. The ammunition feed path may be a curved arc. The curved arc may have a radius of about 6.25 inches. The tower may be configured to connect to the magazine port of a firearm. The tower may be configured to connect to a RUGER 10/22 .22 caliber rifle or an AR-15 rifle.

These and other embodiments of the present disclosure will be discussed more fully in the description. The features, functions, and advantages can be achieved independently in various embodiments of the claimed invention, or may be combined in yet other embodiments.

BRIEF DESCRIPTION OF FIGURES

Like reference numbers and designations in the various drawings indicate like elements.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that modifications to the various disclosed embodiments may be made, and other embodiments may be utilized, without departing from the spirit and scope of the present invention. The following detailed description is, therefore, not to be taken in a limiting sense.

Figure 1:
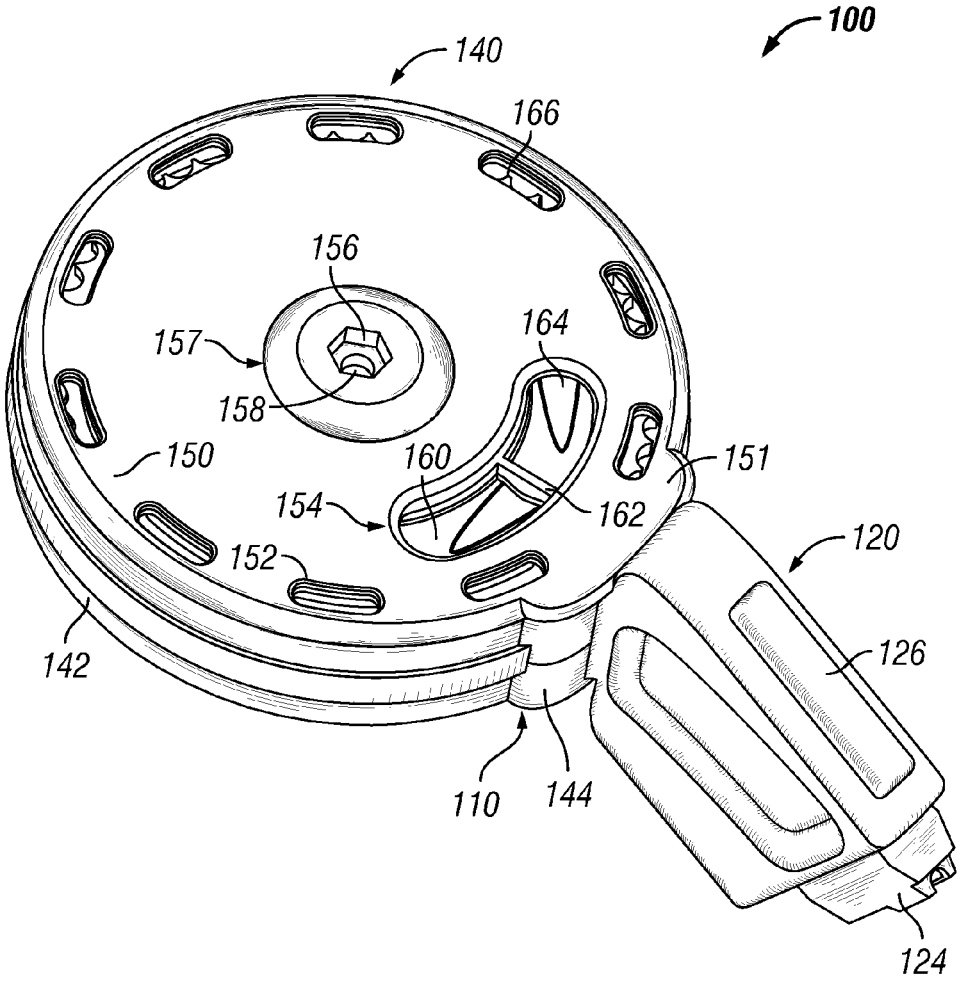
FIG. 1 is a perspective view of an embodiment of a modular magazine assembly.

FIG. 1 is a perspective view of an embodiment of a modular magazine assembly 100 comprising a modular body 140 with a modular tower 120. The body 140 comprises a front casing 142 and a back casing 150. The front and back casings 142, 150 make up the outer portion of the body 140, which further contains a cartridge gear 160 (best shown in FIG. 2) that may convey a plurality of cartridges 136 (shown in FIG. 3).

As shown in FIG. 1, one or more apertures may be formed into the back casing 150. For example, the back casing 150 has a plurality of apertures 152 formed in a ring around the around the outside (outer edge, outer area). Such apertures 152 may allow a user to, among other things, visually inspect the ammunition held within the magazine, or check the amount of ammunition left.

Also shown in FIG. 1 is a gear access aperture 154, which is formed into the back casing 150. The aperture 154 may allow the user access to the cartridge gear 160. With such access the user may adjust the position of the cartridge gear 160, such as, for example, to load the magazine with ammunition, adjust the ammunition, check the tension of the gear 160, or for other suitable reasons, as would be apparent to one of ordinary skill in the art, given the benefit of this disclosure. The cartridge gear 160 further comprises a plurality of ribs 162, each with an associated molded finger recess 164. The ribs 162 may give the user an easy way to move the gear 160. The molded finger recesses 164 may give the user more comfortable grip on the ribs 162. Additionally, the aperture 154 may, at any one time, be long enough to expose one or more ribs 162 and recesses 164. The gear 160 will be further described later in the detailed description.

The front and back casings 142, 150 also include a connection mechanism, such as a fastener. For example, a bolt 112 and nut 114 (best shown in FIG. 2) may be used to secure the front casing 142 to the back casing 150. Further, the casings 142, 150 may be thicker or otherwise fortified in the area of the fastener, which may ameliorate material fatigue at that location. For example, a reinforced portion 157 is shown in FIG. 1.

Figure 2:
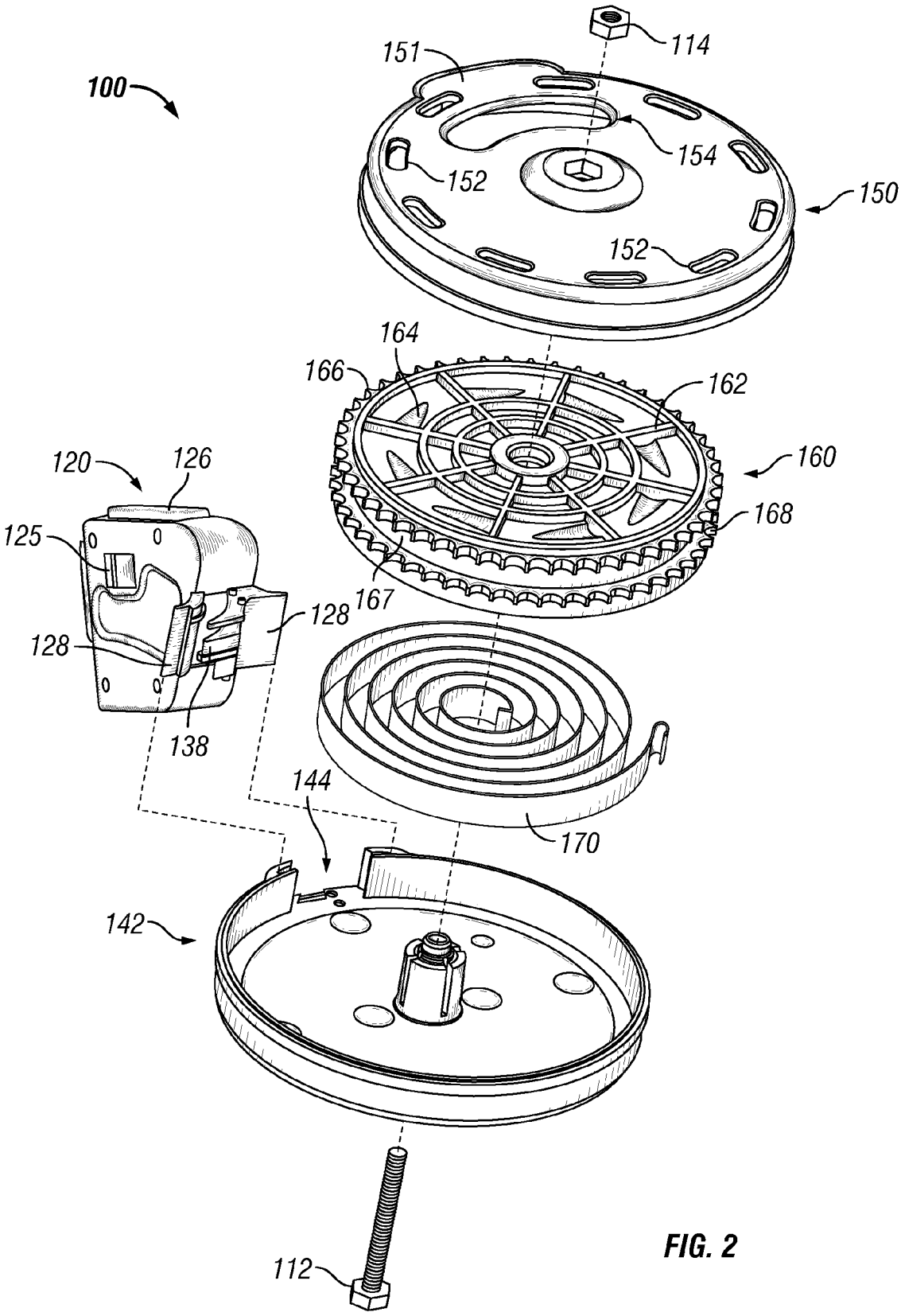
FIG. 2 is an exploded perspective view of the embodiment of FIG. 1, from a different angle.

Referring now to FIG. 2, an outline 156 is molded into the middle of the casing 150. A nut 114 may be placed in the outline 156 which may mate with an associated bolt 112 positioned through a fastener opening 158. Other fastening devices, such as, one or more screws and/or bolts and molded mating profiles, or complementary interlocking profiles, may alternatively or additionally operate to connect the front and back casings 142, 150, as would be apparent to one of ordinary skill in the art, given the benefit of this disclosure.

Within the casings 142, 150, the cartridge gear 160 (shown in FIGS. 2 and 8) may carry cartridges of ammunition in a last in first out configuration. The cartridge gear 160 comprises two rows, a front row 168 and a back row 166, as well as a plurality of ribs 162 and molded finger recesses 164. Additionally, the gear 160 includes a cylindrical opening 169 formed in the center. The opening 169 may allow the extension of a bolt 112 through the gear 160. A tensioning mechanism, such as a spring 170 (shown in FIG. 2) may be connected to the gear 160 and the body 140 and may provide tension on the gear 160, influencing the gear 160 to turn in a specific direction.

As illustrated in FIG. 1, the tower 120 is connected to the body 140 by a connection mechanism 110. In the illustration, the connection mechanism 110 is embodied by a number of recesses and complementary flange profiles. The front casing 142 includes a front flange recess 144 and the back casing 150 includes a back flange recess 151 that complements recess 144. The recesses 144, 151 together may capture a properly configured device, portion, or mechanism, such as the tower 120.

Additionally, the recesses 144, 151 may secure other suitable components, such as, for example, a cover for the body 140, that may protect the internal components of the magazine when another component, such as the tower 120, is not attached. Other suitable components, such as a cartridge loading mechanism or an adapter to allow connection to another device or mechanism, may be captured by the recesses 144, 151, as would be apparent to one of ordinary skill in the art, given the benefit of this disclosure.

As illustrated in FIG. 2, the recesses 144, 151 are configured to capture a flanged component. The base of the tower 120 has a flange 128, which can be captured and secured to the magazine by the recesses 144, 151, thus securing the tower. In some embodiments, the flange 128 may be embodied by a single continuous protrusion, or alternatively, the flange 128 may embodied be a plurality of protrusions, profiles, or contours, as would be apparent to one of ordinary skill in the art, given the benefit of this disclosure.

Figure 3:
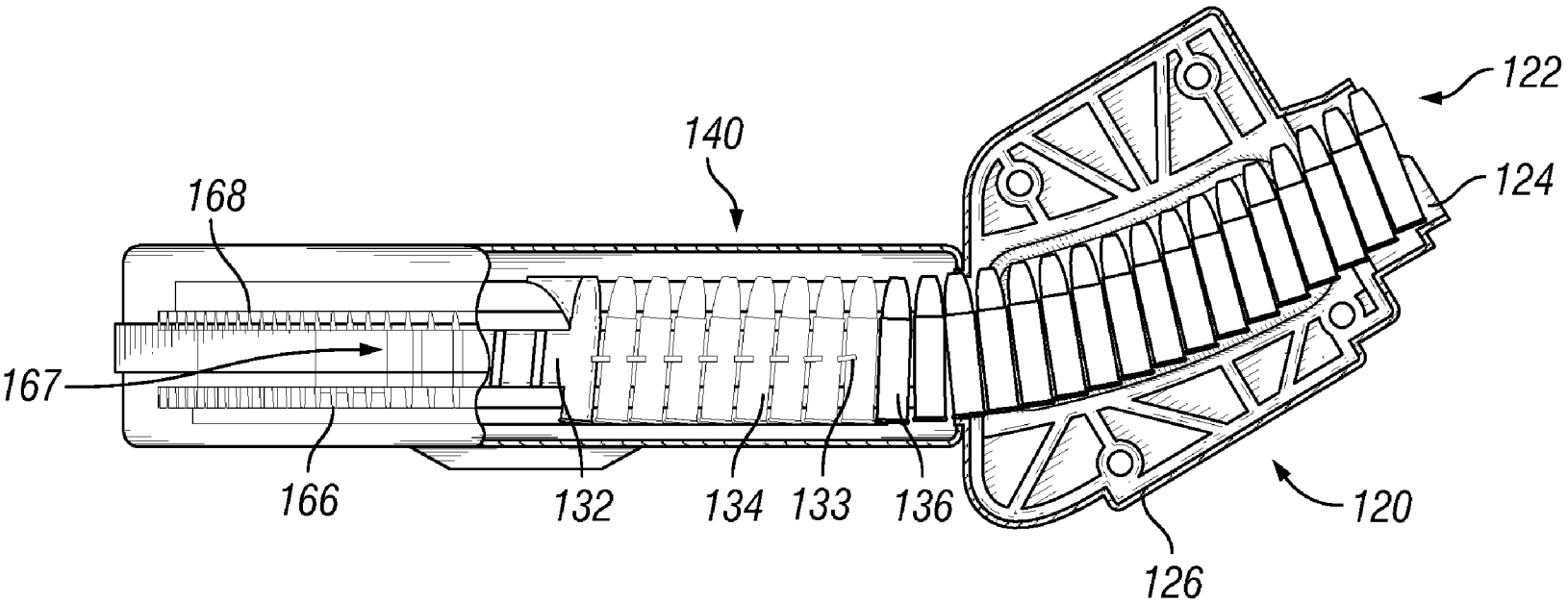
FIG. 3 is a cutaway side view of the embodiment of FIG. 1.

FIG. 3 is a cut away side view of the body 140. The tower 120 further comprises an ammunition feed path 122 that extends from the base through the top of the tower 120. The feed path 122 may convey rounds of ammunition from the base to the top of the tower 120. At the top of the tower 120, an ammunition seat 124 constricts the ammunition feed path 122, and may catch and hold a round of ammunition, thus preventing uncontrolled ejection of cartridges 136 from the magazine assembly 100.

A connection profile 125 is also located on the tower 120. As illustrated in FIG. 2, the connection profile 125 is formed on one side of the tower 120. A firearm 500 (shown in FIG. 5) may comprise a complementary connection mechanism that operates in conjunction with the connection profile 125 to secure the tower 120, and thus the magazine assembly 100, to the firearm 500.

Additionally, the tower 120 comprises an alignment profile 126. The firearm 500 may comprise a complementary alignment profile that operates with the alignment profile 126 to align the tower 120 with the magazine port 510 (shown in FIG. 5) when and if the tower 120 is inserted in the firearm 500.

The body 140 contains the cartridge gear 160 which further comprises a plurality of teeth. The teeth are positioned in a front row 168 and a back row 166 that are separated by a channel 167. Cartridges 136 may be placed across the front and back rows of teeth 168, 166, and may be captured within the recesses between the tips of the teeth.

Figure 9:
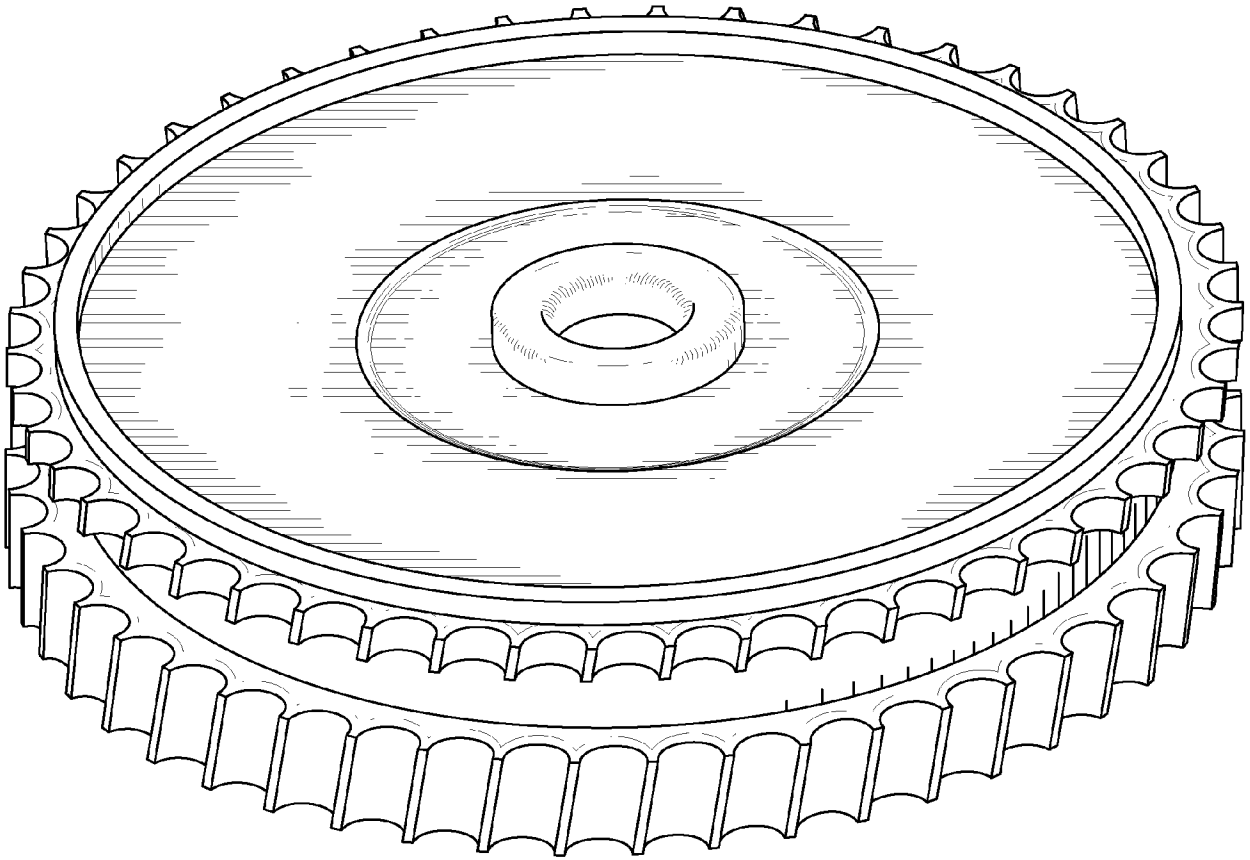
FIG. 9 (Prior Art)
FIG. 9 is a perspective view of a prior art ammunition gear.

As discussed briefly above, previous gears have been molded in a single piece with continuous diagonal recesses molded into the outer rim. An example of a prior art gear is shown in FIG. 9.

Typically, a mold has two halves that are pressed together to form a cavity. The mold may have one or more moving pieces to create a cavity with a desired shape. When the cavity is formed, one or more liquid materials, such as plastics, may flow into the cavity to solidify forming a solid object, such as, for example, the cartridge gear 160. After the object has been formed in the cavity, the object must be removed, preferably without damaging the object and in as few steps as possible. To remove a gear of the style shown in FIG. 9, the pieces of the mold that form the diagonal recesses must be removed. To remove these pieces, a separate turnable portion is required to be included in the mold. The turnable portion may twist pieces of the mold that form the recesses, out and away from the gear without damaging it. A mold with a twisting portion may be more difficult to design, and may be more costly to manufacture, than a mold with a simpler "straight pull" mechanism, which pulls straight out to disengage from a molded object. Because of the diagonal recesses, the molding process for the style of gear shown in FIG. 9 may be slow, complex, and costly.

Figure 8A:
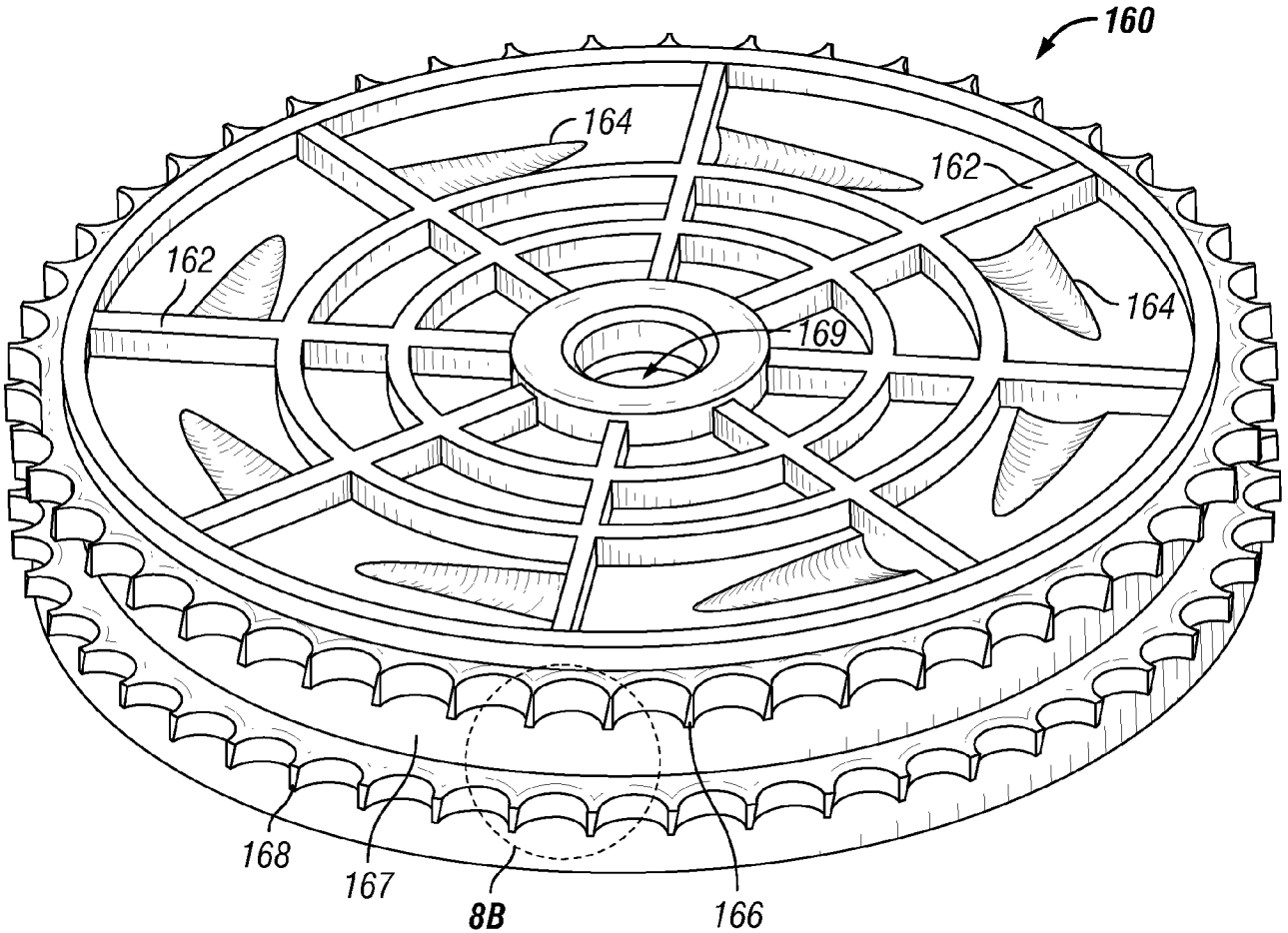
FIG. 8A is a perspective view of an embodiment of an ammunition gear.
Figure 8B:
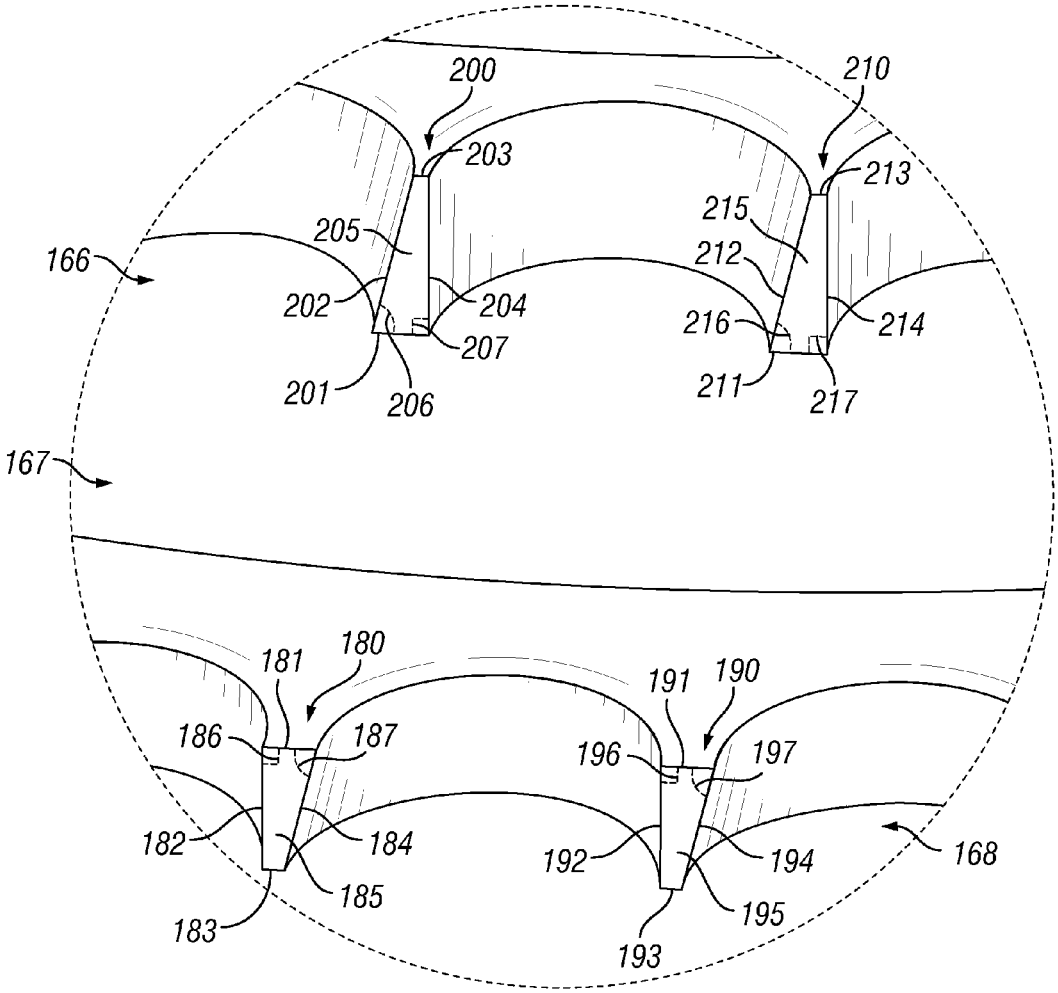
FIG. 8B is a close up partial view of the gear of FIG. 8A.

The cartridge gear 160 (best shown in FIG. 8A) has been shaped such that the twisting portion of a mold, required by past gears, is not necessary. As illustrated by FIGS. 8A and 8B, the rows of teeth 166, 168 may be substantially the same width and may be thin, relative to the prior art gear of FIG. 9.

FIG. 8B is a partial close up isometric view of the gear 160 showing the front and back rows of teeth 168, 166. Left back tooth 200 and right back tooth 210 are included in the back row of teeth 166. Left front tooth 180 and right front tooth 190 are included in the front row of teeth 168.

As shown in FIG. 8B, the left front tooth 180 has face 185 representing the general three dimensional shape of the tooth 180. The face 185 comprises a base 181 positioned nearest the channel 167, a left side 182, a right side 184, and a top 183 that is opposite the base 181. The base 181 has a greater length than the top 183, with the tooth 180 tapering from the base 181 to the top 183, away from the channel 167, along the right side 184. The angle of the taper may be shown by a base-right angle 187, between the base 181 and the right side 184. Opposite the base-right angle 187 is a base-left angle 186, between the base 181 and the left side 182, which, in this embodiment, is a right angle. In some embodiments, the face of the tooth 180 may taper along the left side 182, or may taper along both the left and right sides 182, 184, which would change the angles 186, 187, as would be apparent to one of ordinary skill in the art, given the benefit of this disclosure.

The right front tooth 190 also has a base 191, a face 195, a left side 192, a right side 194, a base-left angle 196 between the base 191 and the left side 192, a base-right angle 197 between the base 191 and the right side 194, and a top 193, and is shaped substantially the same as the left front tooth 180, as are the other teeth of the front row 168.

Also shown in FIG. 8B, the left back tooth 200 has a face 205, a base 201, a left side 202, a right side 204, and a top 203. The base 201 of the left back tooth 200 is nearest the channel 167. The tooth 200 tapers from the base 201 to the top 203, away from the channel 167, along the left side 202. The angle of the taper may be shown by a base-left angle 206, between the base 201 and the left side 202. Opposite the base-left angle 206 is a base-right angle 207, between the base 201 and the right side 204, which, in this embodiment, is a right angle. In some embodiments, the face of the tooth 200 may taper along the right side 204, or may taper along both the left and right sides 202, 204, which would change the angles 206, 207, as would be apparent to one of ordinary skill in the art, given the benefit of this disclosure.

The right back tooth 210 also has a face 215, a base 211, a left side 212, a right side 214, a base-left angle 216 between the base 211 and the left side 212, a base-right angle 217 between the base 211 and the right side 214, and a top 213 and is substantially the same as the left front tooth 200, as are the other teeth of the front row 166.

In some embodiments of the gear 160, the tops of the teeth 183, 193, 203, 213 may taper to a point. Additionally, in some embodiments of the gear 160, the base 181 and the top 183 may be the same length, with the face 185 being substantially rectangular shaped, with no taper. If each of the angles located between the base and the sides for each tooth are 90 degrees or less (i.e. an acute angle), the gear 160 may be molded using a straight pull release motion, rather than with the prior twisting release motion, as would be apparent to one of ordinary skill in the art, given the benefit of this disclosure.

Because the teeth are formed such that a straight pull may be used, one or more portions of a mold, such as a twisting portion, may be omitted. Additionally, one or more molding steps, such as the twisting step, may be omitted. Thus, an embodiment of the cartridge gear 160 in accord with the current disclosure may be molded with a mold that is less complex, less costly to design and produce, and that may be used with a less costly and/or complex mold machine. Finally, because one or more steps may be omitted, the time to mold each gear 160 may also be reduced.

The gear 160 may be constructed using a plurality of suitable pieces, such as, for example, by attaching separate rows of teeth 166, 168 to a cylinder, by machining the gear 160 from one or more pieces, or by connecting other suitable pieces together to form a single cartridge gear 160, as would be apparent to one of ordinary skill in the art, given the benefit of this disclosure.

As shown in FIGS. 8A and 8B, the front and back rows of teeth 168, 166 are offset such that each cartridge 136 is held at an angle. Positioning cartridges 136 at an angle within the gear 160 effectively positions the ammunition at a slight angle to the feed path 122 of the tower 120. As the cartridges 136 move from a position within the body 140 to a position at which they are about to be loaded into the tower 120, the front of each cartridge 136 will reach the base of the tower 120 first and may be raised slightly by a ramp tab 138 (best shown in FIG. 4), assisting the front of the cartridge into the feed path 122 before the rim of the cartridge 136. This asymmetric positioning may reduce the amount of slack seen by each cartridge 136, which may increase the reliability of loading rounds into the feed path 122.

Alternatively, it is conceived that the same effect may be achieved with non-offset rows of teeth 166, 168, but with an embodiment of the tower 120 that is angled with respect to the plane of the magazine body 140, or with an embodiment of the feed path 122 that is extended and/or curved such that the tip of the cartridge 136 will be seen by the feed path 122 before the rim, and thus may be assisted into the feed path 122 as previously described.

Cartridges 136 within the feed path 122 are spaced by their own dimensions. As mentioned previously, the general shape and outer dimensions of a rim fire style cartridge 136 are non-uniform from front to back, having a rim at the base that is of a greater diameter than the rest of the cartridge 136. Due to the rim, these cartridges 136 do not naturally space themselves in parallel, but instead stack at a slight angle from the rim to the tip. To increase loading reliability and decrease jamming, the feed path 122 is slightly curved to accommodate the natural angle of the cartridges 136.

As best shown in FIG. 3, the outer sides of the tower 120 are generally straight, which may conform to the dimensions of a magazine port 510 of a firearm 500, by contrast the ammunition feed path 122 is curved to accommodate rim fire style cartridges 136. An embodiment of the modular tower 120 that is configured to accommodate, for example, a .22 caliber rim fire cartridge, may have an embodiment of the feed path 122 that follows an arc with a radius of about 6.25 inches. Alternatively a feed path 122 with an arc radius of another length, such as an arc length of about 6.125 inches, or about 6.375 inches, or about 6.5 inches, may be suitable, as would be apparent to one of ordinary skill in the art, given the benefit of this disclosure. Additionally, other calibers of rim fire ammunition, such as .17 caliber cartridges, may work best with an alternative arc radius, as would be apparent to one of ordinary skill in the art, given the benefit of this disclosure. Alternatively, some embodiments of a magazine 100 may be configured to carry center fire style cartridges. Such embodiments may have a straight feed path 122.

Figure 4:
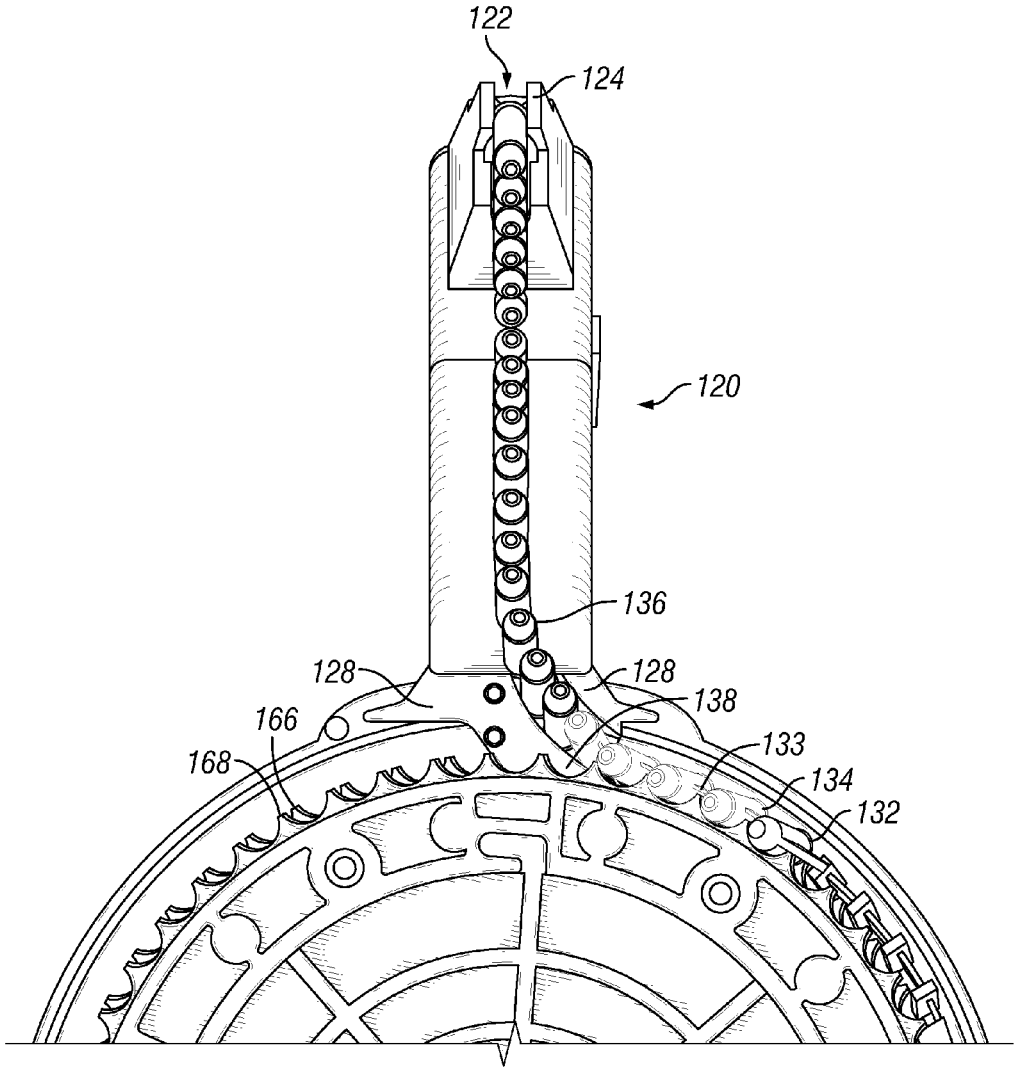
FIG. 4 is a partial cutaway front view the embodiment of FIG. 1 showing the top portion of the assembly.

To assist in the transition of a cartridge 136 from the gear 160 to the feed path 122, the ramp tab 138 is positioned at the base of the tower 120. As best shown in FIG. 4, the ramp tab 138 is positioned between the front and back rows of teeth 168, 166, within a channel 167. The ramp tab 138 extends below the lowest point in the depressions between each tooth (i.e. below the level of each cartridge). As such, the ramp tab 138 may contact a cartridge 136, changing its direction and/or orientation, and assisting it into the feed path 122.

The ramp tab 138 may have differing shapes or contours. For example, the ramp tab 138 may have a contoured lip that is raised from the rest of the ramp tab 138, which may contact the tip of a cartridge 136 to assist with aligning the cartridge as it transitions from the gear 160 to the feed path 122. Alternatively, the ramp tab 138 may not have an additional lip, or may have another suitable shape or configuration, as would be apparent to one of ordinary skill in the art, given the benefit of this disclosure.

Also shown in FIG. 4 is a follower 132 and a dummy round stack 134. The follower 132 is connected to the gear 160 and is positioned to be at the end of the ammunition and to "follow" the ammunition as it is moved through the gear 160. The follower 132 is typically made from a flexible material, such as plastic, which is flexible enough to conform to the contour of the gear 160. The follower 132 may act as a stop when the magazine 100 has dispensed all of its ammunition. When the magazine 100 is out of ammunition, a portion of the follower 132 may rest on the ramp tab of the tower, thus stopping the rotation of the gear 160. A portion of the follower 132 may follow the ammunition into the feed path 122.

Generally, the follower 132 may be flexible in one direction, such as along the contour of the gear 160, but may not flex well in a second direction, such as with the curve of the feed path 122. As such, the follower 132 may not follow the ammunition into the tower 120 and may be paired with one or more dummy rounds that make up a dummy round stack 134, as shown in FIG. 3. The stack 134 may assist in moving live rounds through the feed path 122, to the top of the tower 120, where the ammunition may be accessed by the chambering mechanism of a connected firearm 500. In some embodiments, the stack 134 may replace the follower 132.

The dummy rounds of the stack 134 may be connected by an elastomeric material 133, allowing the group of dummy rounds to expand or contract as necessary. For example, the dummy rounds of the stack 134 may be separated by the teeth when in gear 160. As such the elastomeric material may stretch but would keep the dummy rounds in the stack 134 connected.

During discharge of the firearm 500, the stack 134 may enter the feed path 122. The elastomeric material pulls the dummy rounds together. Additionally, if the tension on the cartridges 136 loaded in to the magazine assembly 100 is relieved, such as by rotating the gear 160, the dummy rounds of the stack 134 may be kept together by the connecting elastomeric material 133 as it moves back through the feed path 122 and into positions on the gear 160.

Figure 5:
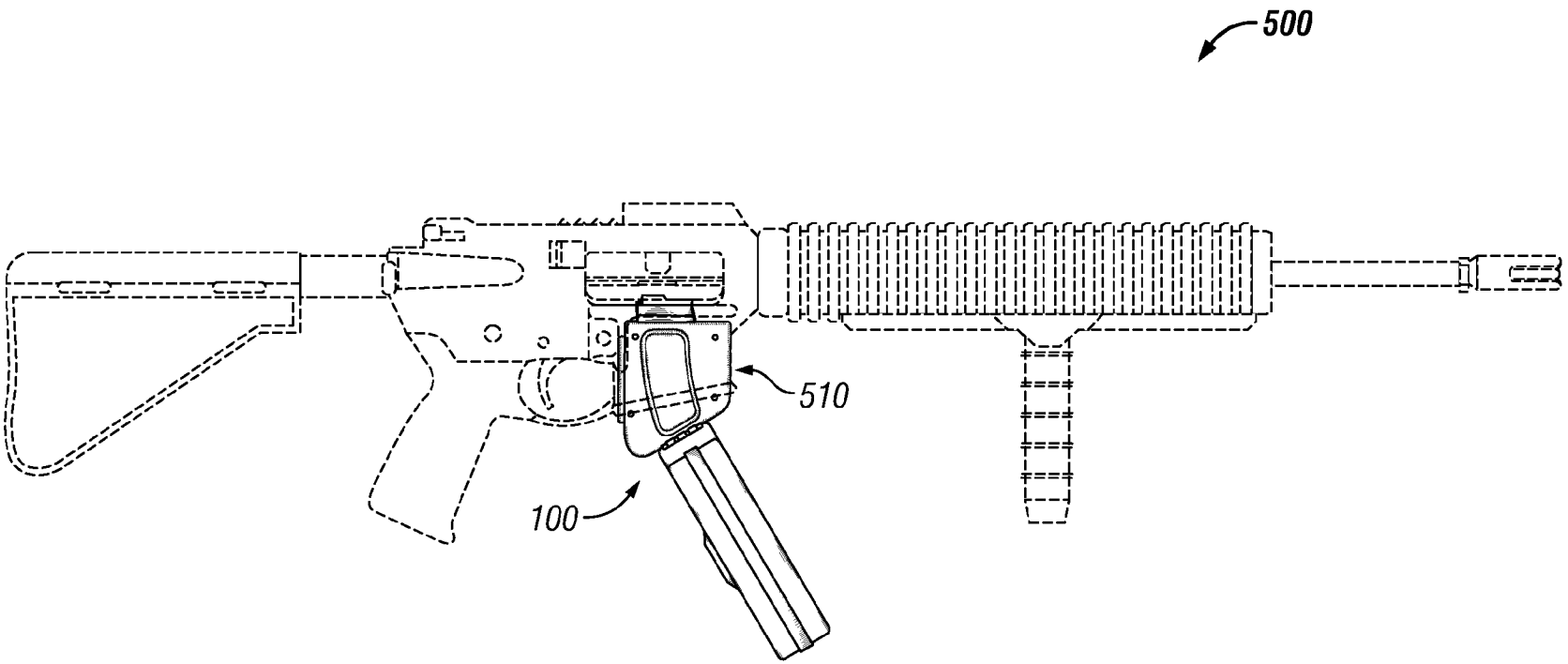
FIG. 5 is a side view of an embodiment of a modular magazine assembly connected to an assault rifle.

FIG. 5 shows the magazine assembly 100 positioned within the magazine port 510 of the firearm 500. As shown, when connected to the firearm 500, the magazine 100 is positioned at a distinct angle from the magazine port 510. Generally, magazines extend straight down from or extend at a curve out from the magazine port 510.

Figure 6:
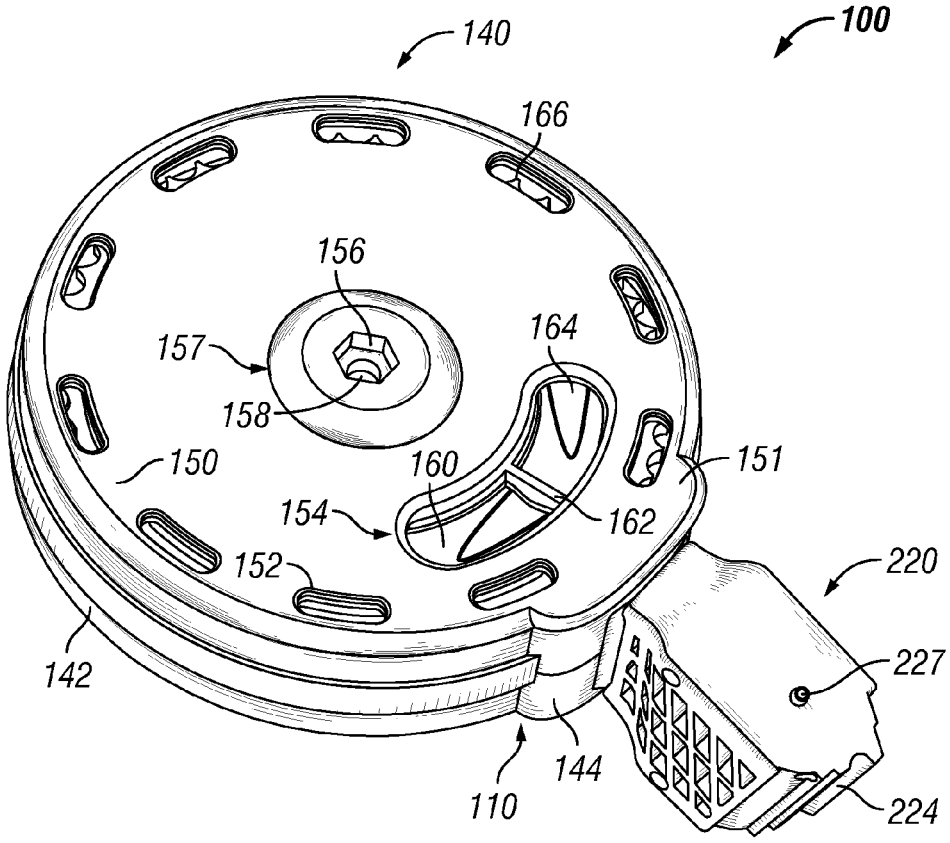
FIG. 6 is a perspective view of another embodiment of a modular magazine assembly.

FIG. 6 shows the body 140 of FIG. 1 with an alternative tower 220 that is configured to connect to an alternative style of firearm. The tower 220 is configured in a similar manner to the tower 120, which will be briefly recapped here. The tower 220 has a flanged base, similar to the flanged base 128 (shown in FIG. 4), which may be captured by the front and back recesses 144, 151. The tower 220 further comprises a feed ramp, an ammunition feed path, and an ammunition seat 224, as discussed with the tower 120.

As can be seen in FIG. 6, the top portion of the tower 220 is contoured to match with a specific style of firearm. The tower 220 may connect to a RUGER 10/22 .22 caliber rifle, which typically receives a rotary magazine with a 10 cartridge capacity, though other magazines with different capacities and suitable connecting mechanisms are known. The tower 220 is designed to conform to the shape of the rotary magazine, but another shape suitable for connecting with the firearm 700 may be used, as would be apparent to one of ordinary skill in the art, given the benefit of this disclosure.

Figure 7:
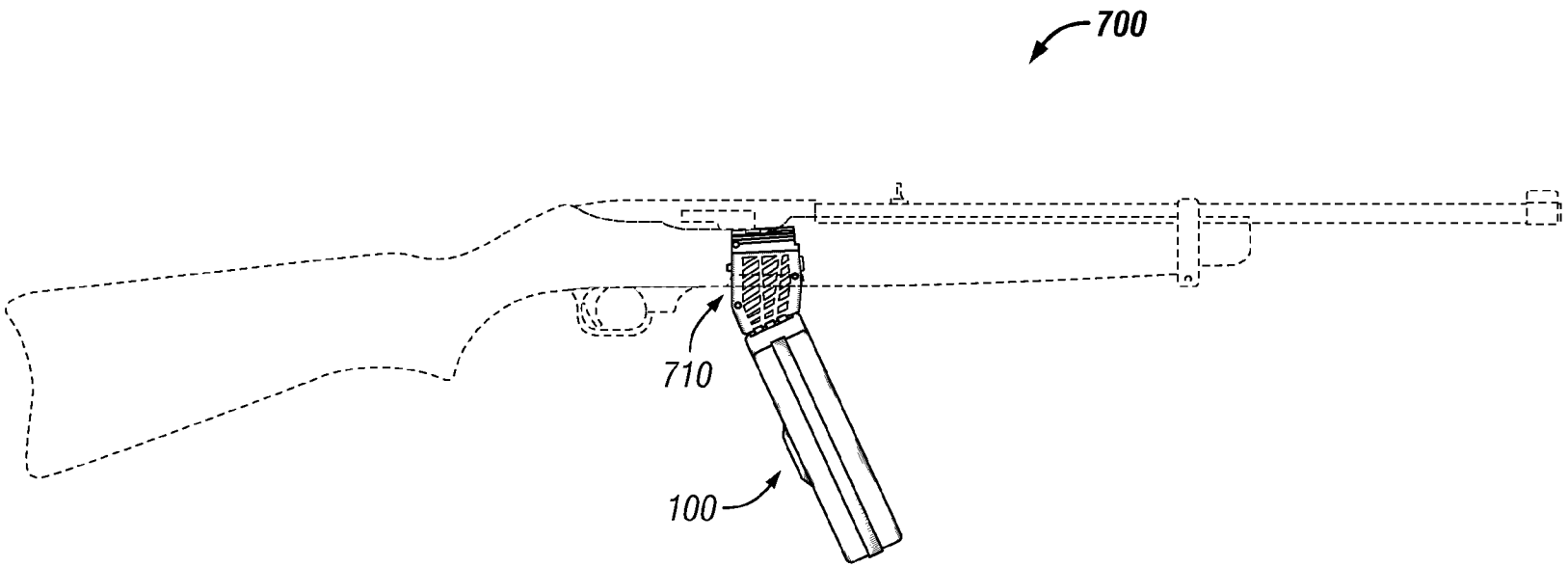
FIG. 7 is a side view of the embodiment of FIG. 6 connected to a rifle.

The tower 220 further comprises a back guide pin 227 at the back, and may further have a front guide pin at the front of the tower 220. The guide pin 227 may used to guide the insertion of the tower 220 into a magazine port 710 of a suitable firearm 700, as shown in FIG. 7. Additionally, the guide pin 227 may be used to secure the tower 220 to the firearm 700.

FIG. 7 shows the magazine assembly 100 positioned within the magazine port 710 of the firearm 700. As shown, when connected to the firearm 700, the magazine 100 is positioned at a distinct angle from the magazine port 710.

As shown and described above, a plurality of styles of tower 120, 220 may be connected to a single style of modular magazine 140. Additionally, a plurality of styles of modular magazine may be used with a single style of tower. For example, a suitable tower that may be used with a suitably configured stick magazine, box magazine, tubular magazine, rotary magazine, pan magazine, helical magazine, or other suitable magazine, as would be apparent to one of ordinary skill in the art, given the benefit of this disclosure.

To change the modular tower 120 to the modular tower 220, a user may remove the bolt 112 and the nut 114 that connect the casings 142, 150. When the fastener is removed from the body, the back casing 150 may be removed from the body 140 exposing the cartridge gear 160 and the base of the tower 120. With the back casing 150 removed, the tower 120 may be removed from the recess 144 of the front casing 142. The tower 220 may then be positioned within the recess 144 and the back casing 150 may be returned to the body 140. The recess 151 of the back casing 150 is positioned such that the tower 220 is captured, securing the tower 220 to the body 140. The bolt 112 and nut 114 may then be replaced to finish the reconstruction of the modular magazine assembly 100.

Although this invention has been described in terms of certain preferred embodiments, other embodiments that are apparent to those of ordinary skill in the art, including embodiments that do not provide all of the features and advantages set forth herein, are also within the scope of this invention. Therefore, the scope of the present invention is defined only by reference to the appended claims and equivalents thereof.

What is claimed is:

1. A modular magazine assembly comprising:

a tower configured to be inserted into and connected to a magazine port of a firearm and having an ammunition feed path configured to convey cartridges of ammunition to the firearm; and a rotary magazine body connected to the tower and configured to convey cartridges to the tower, the body including a cartridge gear configured to rotate about a central axis and to convey cartridges to the tower by the rotation, the cartridge gear having a front row of teeth with front recesses between pairs of teeth and a back row of teeth with back recesses between pairs of teeth, the front teeth recesses being offset from the back teeth recesses to hold cartridges at an angle with respect to the central axis, the angle being configured to convey cartridges front first into the feed path of the tower.

2. The modular magazine assembly of claim 1, wherein the modular magazine assembly is configured to convey .22 caliber rim fire cartridges of ammunition to the firearm.

3. The modular magazine assembly of claim 1, wherein the magazine body comprises a front casing having a front flange recess and a back casing having a back flange recess and the tower comprises a first flange complementary to a portion of the front flange recess and to a portion of the back flange recess and a second flange complementary to another portion of the front flange recess and to another portion of the back flange recess, the portion of the front and back recesses capturing the first flange, the other portion of the front and back recesses capturing the second flange, and the front and back flange recesses being configured to connect to a plurality of styles of towers that include like first and second complementary flanges.

4. The modular magazine assembly of claim 1, further comprising a channel in the cartridge gear between the front and back rows of teeth, wherein the front and back teeth recesses are configured so that cartridges held therein span the channel from a given back teeth recess to a corresponding offset front teeth recess with fronts of cartridges held in the front teeth recesses.

5. The modular magazine assembly of claim 1, wherein the modular magazine assembly is for use with a rifle.

6. The modular magazine assembly of claim 1, wherein the magazine body and tower are configured to accommodate rim fire ammunition.

7. The modular magazine assembly of claim 4, wherein the tower further comprises a ramp tab that extends into the channel between the front and back row of teeth of the cartridge gear, and wherein the ammunition feed path is curved at an arc.

8. The modular magazine assembly of claim 7, wherein the curved arc has a radius of 6.125 to 6.5 inches.

9. A modular magazine assembly comprising:

a modular magazine body configured to be loaded with cartridges of ammunition, the magazine body comprising a front casing having a front flange recess and a back casing having a back flange recess; and a modular tower connected to the modular magazine at a first end of the tower by a a first flange complementary to a portion of the front flange recess and to a portion of the back flange recess and by a second flange complementary to another portion of the front flange recess and to another portion of the back flange recess, the portion of the front and back recesses capturing the first flange, the other portion of the front and back recesses capturing the second flange, the front and back flange recesses being configured to connect to a plurality of styles of towers that include like first and second complementary flanges, the modular tower having an ammunition feed path extending from the first end of the tower between the first and second flanges to a second end of the tower, the second end of the tower having a cartridge seat that constricts the feed path, the tower being configured to connect to a single configuration of magazine port, wherein the modular magazine body is configured to provide cartridges of ammunition to the modular tower.

10. The modular magazine assembly of claim 9, wherein the modular magazine body is a rotary, modular magazine body and further comprises a cartridge gear configured to rotate about a central axis and to provide cartridges to the modular tower by the rotation, the cartridge gear having a front row of teeth with front recesses between pairs of teeth and a back row of teeth with back recesses between pairs of teeth, the front teeth recesses being offset from the back teeth recesses to hold cartridges at an angle with respect to the central axis, the angle being configured to provide cartridges front first into the feed path of the tower.

11. The modular magazine assembly of claim 10, further comprising;

a follower connected to the cartridge gear;

a channel in the cartridge gear between the front and back rows of teeth, wherein the front and back teeth recesses are configured so that cartridges held therein span the channel from a given back teeth recess to a corresponding offset front teeth recess with fronts of cartridges held in the front teeth recesses; and a ramp tab that extends from the tower into the channel between the front and back row of teeth of the cartridge gear.

12. The modular magazine assembly of claim 9 wherein the modular magazine assembly is configured to provide .22 caliber rim fire cartridges of ammunition.

13. A modular magazine assembly comprising:

a tower including:

a first end, the first end having a first interface that is configured to be accepted by a magazine port of a firearm, the first end including a cartridge seat;

a second end, the second end having a second interface configured to connect to a magazine body; and an ammunition feed path extending from the first end to the second end, being constricted by the cartridge seat, and being configured to convey cartridges between the second end and the first end; and a rotary magazine body connected to the tower and configured to convey cartridges through the second end of the tower, the body including:

a cartridge gear configured to rotate about a central axis and to convey cartridges through the second end by the rotation, the cartridge gear having a front row of teeth with front recesses between pairs of teeth and a back row of teeth with back recesses between pairs of teeth;

a channel in the cartridge gear between the front and back rows of teeth, the front and back teeth recesses being configured so that cartridges held therein span the channel from a given back teeth recess to a corresponding front teeth recess with fronts of cartridges held in the front teeth recesses; and tapers of the teeth in the front and back rows, the tapers occurring away from the channel with the greatest tooth width nearest the channel.

14. The modular magazine assembly of claim 13, further comprising a ramp tab connected to the second end of the tower that extends into the channel between the front and back row of teeth of the cartridge gear.

15. The modular magazine assembly of claim 13, wherein the magazine body comprises a front casing having a front flange recess and a back casing having a back flange recess and wherein the second end comprises a first flange complementary to a portion of the front flange recess and to a portion of the back flange recess and a second flange complementary to another portion of the front flange recess and to another portion of the back flange recess, the portion of the front and back recesses capturing the first flange and the other portion of the front and back recesses capturing the second flange.

16. The modular magazine assembly of claim 13, wherein the modular magazine assembly is configured to feed .22 caliber rim fire cartridges.

17. The modular magazine assembly of claim 13, wherein the ammunition feed path is a curved arc.

18. The modular magazine assembly of claim 17, wherein the curved arc has a radius of 6.125 to 6.5 inches.

19. The modular magazine assembly of claim 13, wherein the front teeth recesses are offset from the back teeth recesses to hold cartridges an angle with respect to the central axis, the angle being configured to convey cartridges front first into the feed path of the tower.

20. The modular magazine assembly of claim 19, wherein the modular magazine assembly is for use with a rifle.

* * * * *